US006837542B2

(12) United States Patent
Barile, Jr. et al.

(10) Patent No.: US 6,837,542 B2
(45) Date of Patent: Jan. 4, 2005

(54) FRAME FOR A STACKABLE CHAIR

(75) Inventors: Peter W. Barile, Jr., Morristown, TN (US); Manfred Steinfeld, Boca Raton, FL (US)

(73) Assignee: Daniel Paul Chairs, LLC, Morristown, TN (US)

( * ) Notice: Subject to any disclaimer, the term of this patent is extended or adjusted under 35 U.S.C. 154(b) by 0 days.

(21) Appl. No.: 10/440,827

(22) Filed: May 19, 2003

(65) Prior Publication Data

US 2004/0232746 A1 Nov. 25, 2004

(51) Int. Cl.[7] ..... A47C 3/04
(52) U.S. Cl. ..... 297/239; 297/446.2
(58) Field of Search ..... 297/446.1, 446.2, 297/239, 59, 60, 449.1, 449

(56) References Cited

U.S. PATENT DOCUMENTS

| | | | | | |
|---|---|---|---|---|---|
| 168,828 | A | * | 10/1875 | Brick | 297/446.1 |
| 320,629 | A | * | 6/1885 | Closterman | 297/449.1 |
| 374,997 | A | * | 12/1887 | Remaly | 297/449.1 |
| 549,708 | A | * | 11/1895 | Dennett | 297/449.1 |
| 648,728 | A | * | 5/1900 | Crocker | 297/446.1 |
| 873,265 | A | * | 12/1907 | Petroskey | 297/446.2 |
| 942,570 | A | * | 12/1909 | Lawrence | 297/449.1 |
| 1,291,551 | A | * | 1/1919 | Kirk | 297/60 |
| 1,821,636 | A | * | 9/1931 | Harter | 297/449.1 |
| 2,004,934 | A | * | 6/1935 | Dellert | 297/183.1 |
| 3,203,731 | A | | 8/1965 | Krueger | |
| 3,316,016 | A | | 4/1967 | Petersen | |
| 4,057,288 | A | | 11/1977 | Schwartz et al. | |
| 5,762,396 | A | | 6/1998 | Barile | |
| 6,174,029 | B1 | | 1/2001 | Swy | |

* cited by examiner

*Primary Examiner*—Peter M. Cuomo
*Assistant Examiner*—Joseph Edell
(74) *Attorney, Agent, or Firm*—Pitts & Brittian, P.C.

(57) ABSTRACT

A chair frame (10) for a stackable chair. The chair frame (10) includes a seat support (12) for supporting the seat (22) of the stackable chair, the seat support (12) of the frame (10) defining first and second side frame portions (18, 20). The chair frame (10) also includes first and second front leg members (24, 26) and first and second rear leg members (28, 30) extending downwardly from the seat support (12). A back support (36) is secured to the seat support (12), the back support (36) defining first and second side portions (38, 40) and a lower frame portion (44) disposed between the first and second side portions (38, 40) of the back support (36). Also included are first and second bracing structures (46, 48) extending between the seat support (12) and the back support (36), whereby the bracing structures (46, 48) strengthen the engagement of the seat support (12) with the back support (36).

9 Claims, 6 Drawing Sheets

FRAME FOR A STACKABLE CHAIR

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

This invention relates to a chair frame for stackable chairs. More specifically, the present invention is related to a chair frame provided with a bracing system that enhances the durability of the resulting chair without impairing the ease with which chairs utilizing the frame can be stacked, or the stability of the resulting stack of chairs.

2. Description of the Related Art

Chairs which can be stacked upon one another to facilitate their storage are known in the art. For example, such chairs are disclosed in U.S. Pat. Nos. 3,316,016, 4,057,288, 5,762,396, and 6,174,029 B1. It is desirable that stackable chairs be light weight, such that they can be easily lifted during stacking and unstacking. Therefore, stackable chairs are typically fabricated of light weight tubular metal materials, such as aluminum. However, stackable chairs tend to take a great deal of abuse, particularly while being stacked or unstacked, and such light weight fabricating materials can deform, or otherwise be damaged, such that a chair may not stack properly or be useable for seating. For example, maintenance of the desired angular disposition of the back of a stackable chair relative to the seat portion may be critical to the proper stacking of chairs. Where the back support portion of the chair frame has been bent or deformed, the chair may not properly interlock with the chair stacked above, making stacking impossible, or rendering the resulting stack of chairs unstable. With chairs which are not stackable, bracing structures can easily be added without great concern over the additional weight. However, locating bracing structures on stackable chairs without impairing the ability of the chairs to properly and efficiently interlock for purposes of stacking can be problematic. Moreover, adding extensive bracing structures to the primary components of a stackable chair increases the weight of the chair, such that the ease with which the chairs can be stacked and unstacked can be compromised.

In U.S. Pat. No. 3,203,731 a stackable chair having a folding back is disclosed. Because the back portions are folded down over the seat prior to stacking, the need for reinforcing the connection between the back portion and seat portion to insure stackability is obviated, but the hinge mechanism which is required adds cost to the chair. In addition, the relatively thick back portion is folded over the seat portion, fewer chairs can be stacked without the height of the stack becoming untenable. Accordingly, the prior art does not disclose a chair frame which adequately addresses the problem of deformation of, or damage to, the chair frame which undermines the stackability of stackable chairs.

BRIEF SUMMARY OF THE INVENTION

The present invention provides a chair frame for a stackable chair. The chair frame includes a seat support for supporting the seat of the stackable chair, the seat support having first and second side frame portions, a front frame portion and a rear frame portion. The first and second side frame portions extend between the front frame portion and the rear frame portion. The chair frame further includes first and second front leg members, and first and second rear leg members, extending downwardly from the seat support. The first rear leg member is secured to the first outer end portion of the rear frame portion of the seat support, and the second rear leg member is secured to the second outer end portion of the rear frame portion. In this regard, the first outer end portion of the rear frame portion extends outwardly beyond the first side frame portion of the seat support to engage the first rear leg member, and the second outer end portion of the rear frame portion extends outwardly beyond the second side frame portion to engage the second rear leg member. As a result, the rear leg members are outwardly displaced from the points at which the side frame portions of the seat support engage the rear frame portion of the seat support in order to facilitate the stacking of chairs utilizing the chair frame.

The chair frame also includes a back support secured to the seat support, the back support having first and second upright side portions and a lower frame portion disposed between the first and second side portions of the back support. In order to strengthen and reinforce the connection between the back support and the seat support, the chair frame includes first and second bracing structures. The first bracing structure is secured at one end to the first side frame portion of the seat support at a point selectively spaced from the point at which the first side frame portion engages the rear frame portion of the seat support, and is secured at the other end to the lower frame portion of the back support. Accordingly, the first bracing structure extends diagonally from the first side frame portion of the seat support to the lower frame portion of the back support. Similarly, the second bracing structure is secured at one end to the second side frame portion of the seat support at a point selectively spaced from the point at which the second side frame portion engages the rear frame portion of the seat support, and is secured at the other end to the lower frame portion of the back support. Thus, the second bracing structure extends diagonally from the second side frame portion of the seat support to the lower frame portion of the back support. The first and second bracing structures provide a bracing system that enhances the durability of the resulting chair without impairing the ease with which the chairs can be stacked, or the stability of the resulting stack of chairs.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Figure 7:
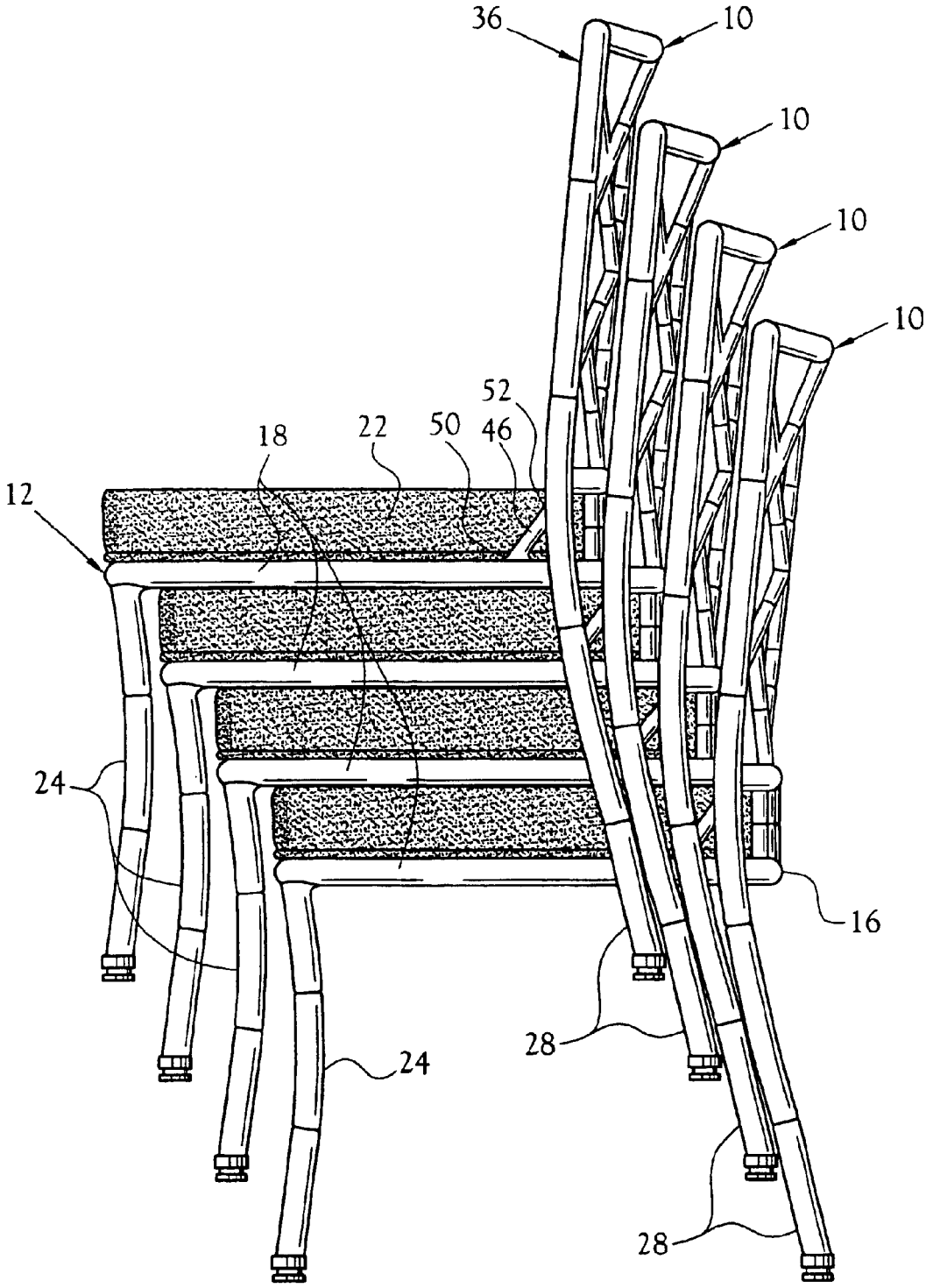
FIG. 7 is a side elevation view of a plurality of chairs utilizing the chair frame of the present invention which have been placed in a stacked disposition.

A frame for a stackable chair incorporating various features of the present invention is illustrated generally at 10 in the drawings. As is illustrated in FIG. 7 the chair frame 10 is designed such that chairs incorporating the frame 10 can be stacked, one upon another, to facilitate the storage of a plurality of chairs. As will be discussed in detail below, the chair frame 10 is provided with a bracing system that enhances the durability of the resulting chair without impairing the ease with which the chairs can be stacked, or the stability of the resulting stack of chairs. In the preferred embodiment the chair frame 10 is fabricated of a tubular metal, such as aluminum, but it will be understood that various fabricating materials can be used. For purposes of the discussion herein, the term "chair" is intended to include chairs, benches and stools, as well as other seating structures having legs of various lengths.

The chair frame 10 includes a seat support 12 which in the preferred embodiment defines a front frame portion 14, a rear frame portion 16, and a pair of oppositely disposed side frame portions 18 and 20 which extend between the front frame portion 14 and the rear frame portion 16. The seat portion 12 is used to support the seat 22 of a chair utilizing the frame 10. In this regard, it will be noted that in the preferred embodiment the seat support 12 includes a cross support member 23 which extends between the side frame portions 18 and 20 to support the rear portion of the seat 22. Whereas the seat support 12 of the chair frame 10 is illustrated as being fabricated of a tubular material which supports the seat 22 proximate its perimeter, it is contemplated that the seat support 12 can define other configurations such as, for example, a platform (not shown) over which a seat cushion is positioned.

Figure 6:
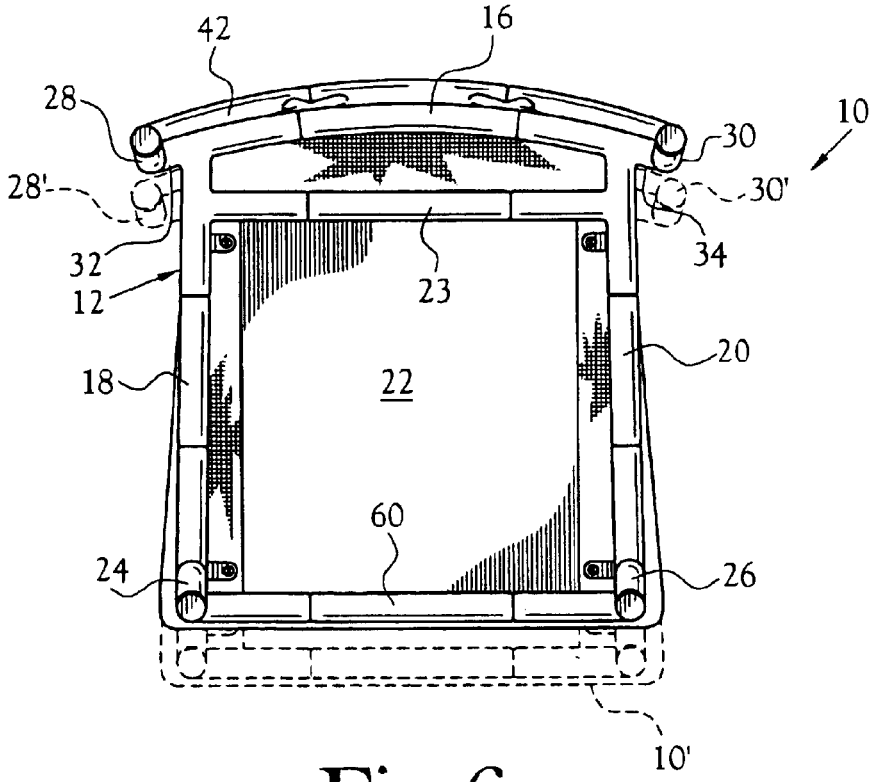
FIG. 6 is a bottom plan view of a chair frame of the present invention.

The chair frame 10 also includes a pair of front legs 24 and 26, and a pair of rear legs 28 and 30. In the preferred illustrated embodiment the upper end of the front leg 24 engages the seat support 12 of the frame 10 at the intersection of the front frame portion 14 and the side frame portion 18, and the upper end of the front leg 26 engages the seat support 12 at the intersection of the front frame portion 14 and the side frame portion 20. However, it will be noted that the rear frame portion 16 of the seat support 12 extends beyond the side frame portions 18 and 20, and the outer ends 32 and 34 of the rear frame portion 16 engage the rear legs 28 and 30, respectively, such that the rear legs 28 and 30 are outwardly displaced from the points at which the side frame portions 18 and 20 intersect the rear frame portion 16. As a consequence of this construction, and as best illustrated in FIG. 6, the width of the seat portion 12 proximate the point at which the side frame portions 18 and 20 engage the rear frame portion 16 is less than the distance between the rear legs 28 and 30. Thus, as illustrated in FIG. 6 when a chair incorporating a frame 10' is stacked upon another chair incorporating a frame 10, the rear legs 28' and 30' of the upper chair are received on either side of the side frame portions 18 and 20 of the lower chair, and in front of the rear legs 28 and 30 of the lower chair, to facilitate the stacking of the chairs.

The chair frame 10 of the present invention also includes a back support 36 which defines a pair of upright frame portions 38 and 40 and an upper frame portion 42 and a lower frame portion 44. In the preferred embodiment the back support 36 is fabricated of a tubular material. However, it is contemplated that the back support 36 could comprise a solid, or substantially solid, panel such that the upper and lower portions of the solid, or substantially solid, panel define the upper frame portion 42 and the lower frame portion 44, respectively. It will also be noted that in the preferred illustrated embodiment the upright frame portions 38 and 40 are integrally formed with the rear legs 28 and 30, respectively. However, it will be understood that the upright frame portions 38 and 40, and the rear legs 28 and 30, can define separate components.

In order to strengthen, and increase the durability of the chair frame 10, the frame 10 is provided with a pair of bracing structures 46 and 48. In the preferred embodiment, the bracing structure 46 defines a first end 50 which engages the side frame portion 18 at a point spaced from the point at which the side frame portion 18 engages the rear frame portion 16, and defines a second end 52 which engages the lower frame portion 44 of the back support 36. Accordingly, the bracing structure 46 extends diagonally between the side frame portion 18 and the lower frame portion 44 thereby reinforcing the junction of the seat support 12 and back support 36. Similarly, the bracing structure 48 defines a first end 54 which engages the side frame portion 20 at a point spaced from the point at which the side frame portion 20 engages the rear frame portion 16, and defines a second end 56 which engages the lower frame portion 44 of the back support 36. Accordingly, the bracing structure 48 extends diagonally between the side frame portion 20 and the lower frame portion 44 thereby further reinforcing the junction of the seat support 12, and back support 36.

Figure 4:
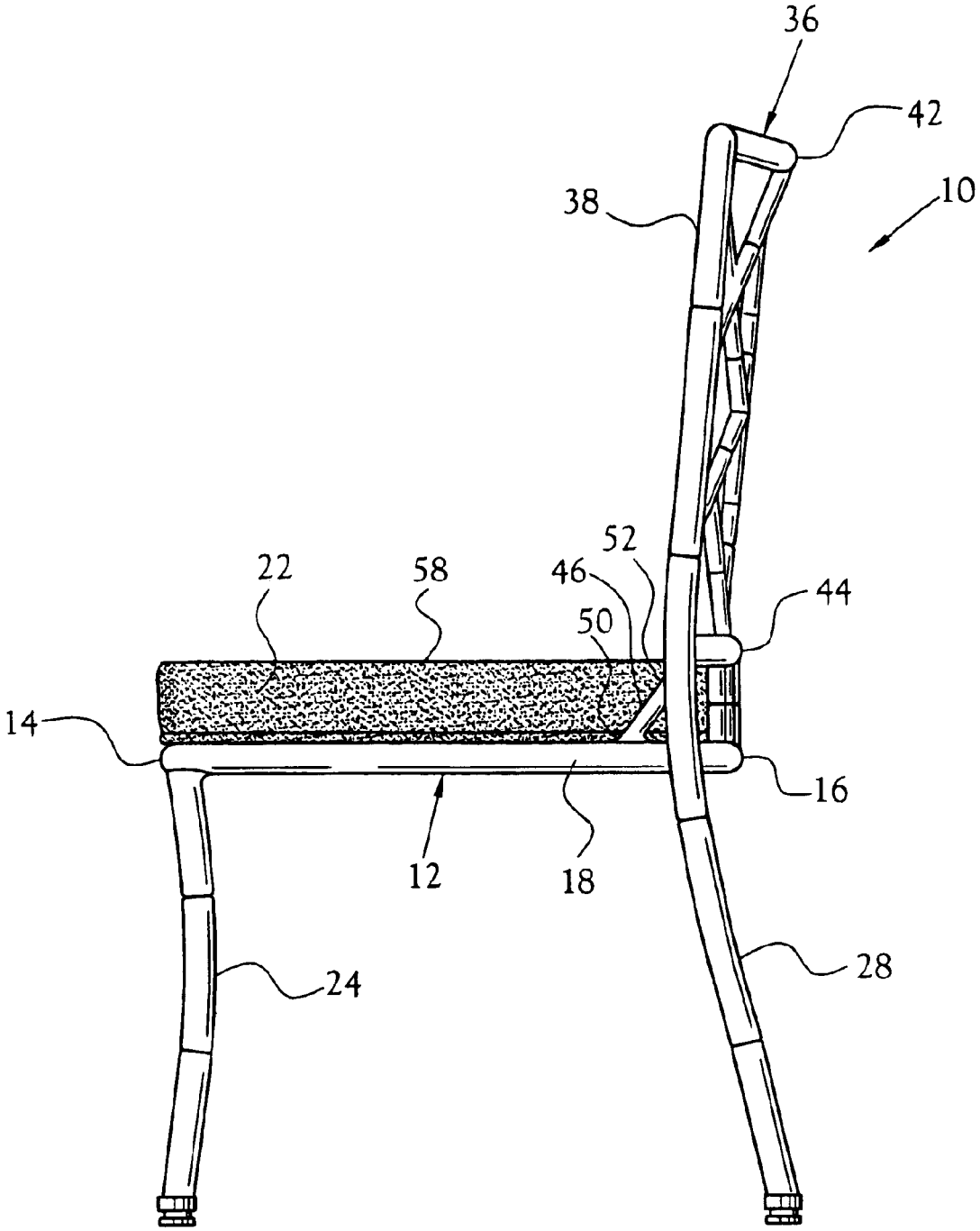
FIG. 4 is a side elevation view of a chair frame of the present invention.
Figure 5:
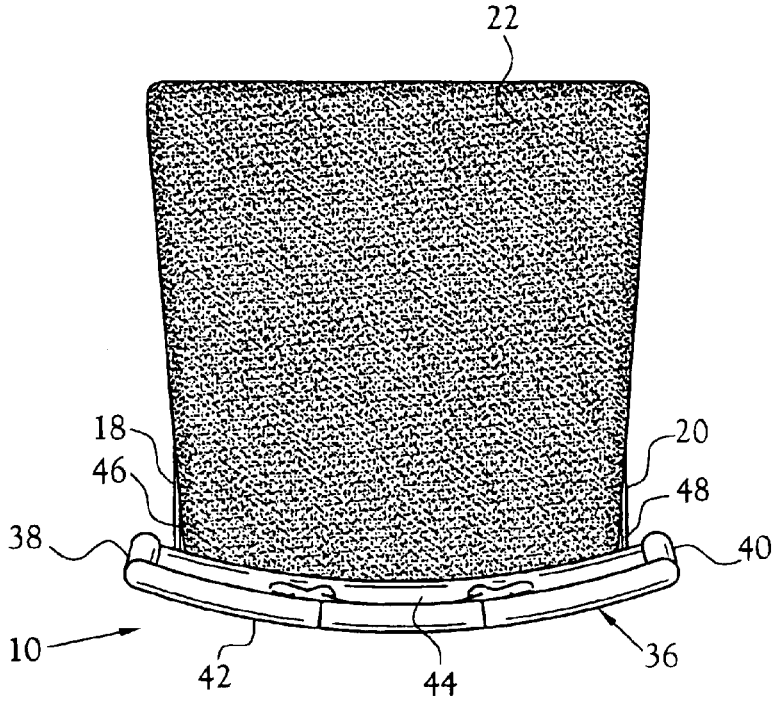
FIG. 5 is a top plan view of a chair frame of the present invention.

It will be noted that the second ends 52 and 56, of the bracing structures 46 and 48 engage the lower frame portion 44 at points inwardly spaced from the upright frame portions 38 and 40, respectively, such that the bracing structures 46 and 48 serve to reinforce the junction of the seat support 12, and back support 36, but do not inhibit chairs incorporating the frame 10 from properly interlocking when the chairs are stacked. Further, in the preferred embodiment, the lower frame portion 44 of the back support 36 is positioned at approximately the same height as the upper surface 58 of the seat 22. (See FIG. 4) As a consequence, the bracing structures 46 and 48 engage the lower frame portion 44 at approximately the same height as the upper surface 58 of the seat 22. This construction insures that the bracing structures 46 and 48 do not extend above the seat 22 to the extent that they inhibit the proper stacking of chairs utilizing the frame 10.

Figure 1:
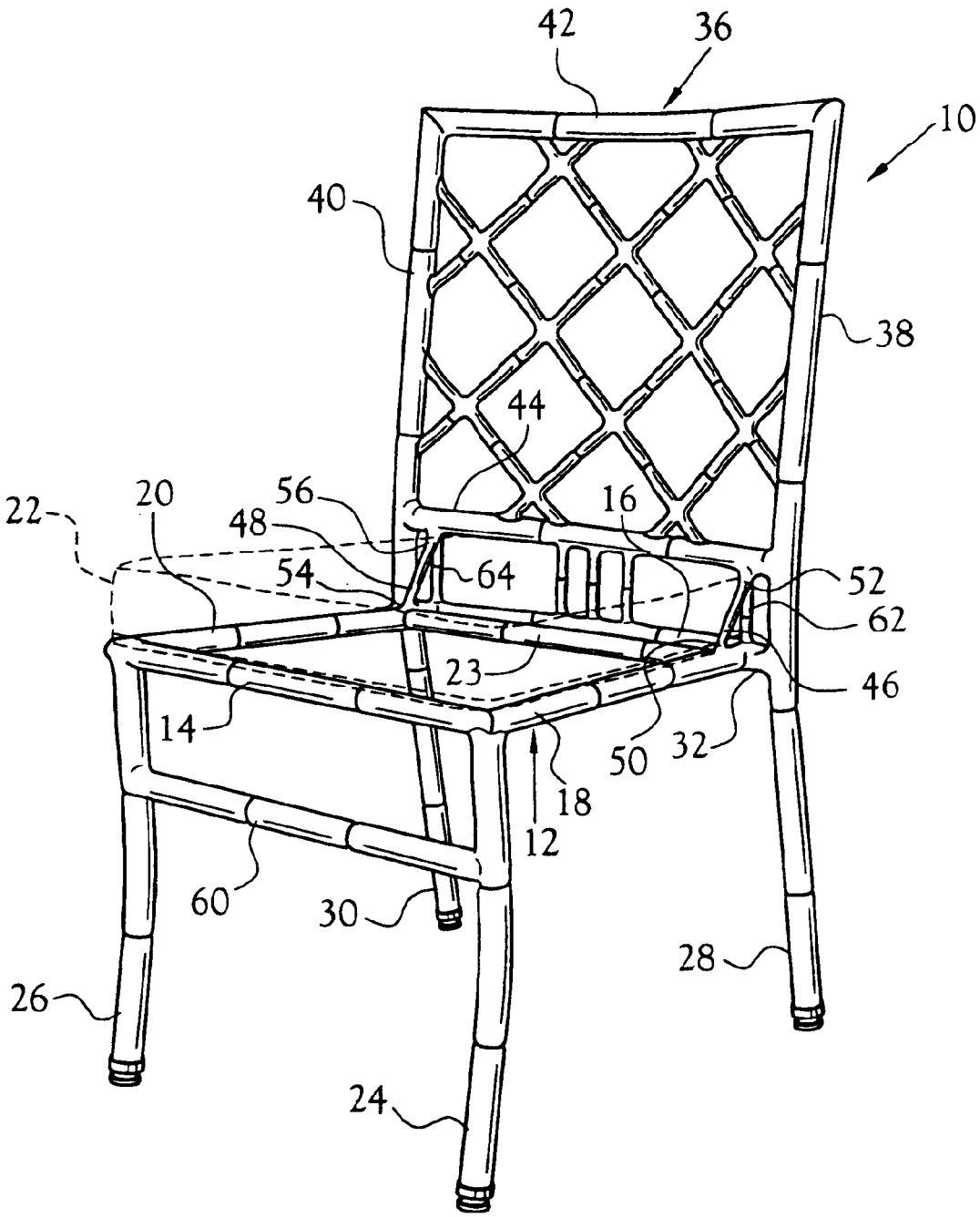
FIG. 1 is a perspective view of a frame for a stackable chair of the present invention.
Figure 2:
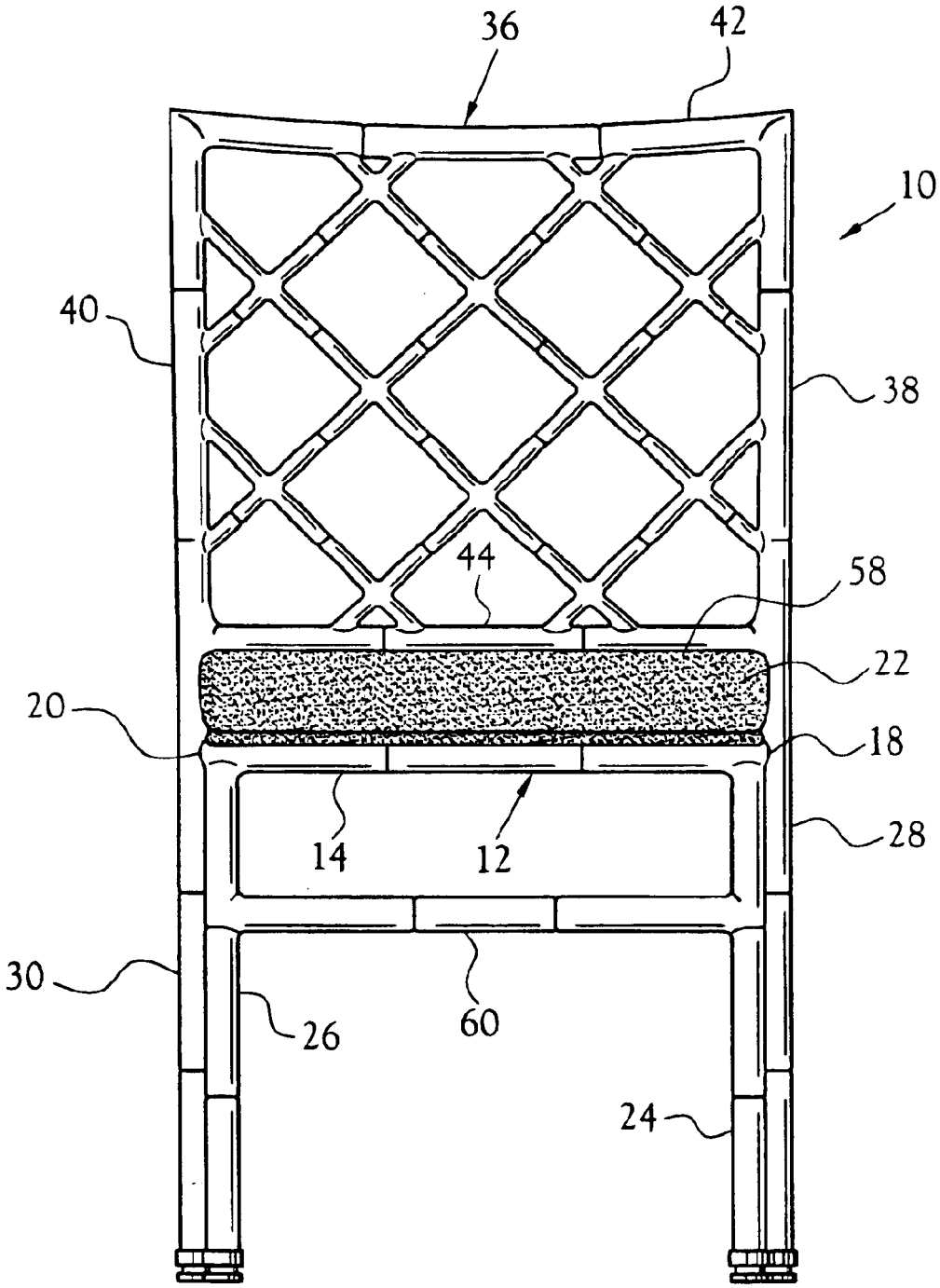
FIG. 2 is a front elevation view of a chair frame of the present invention.
Figure 3:
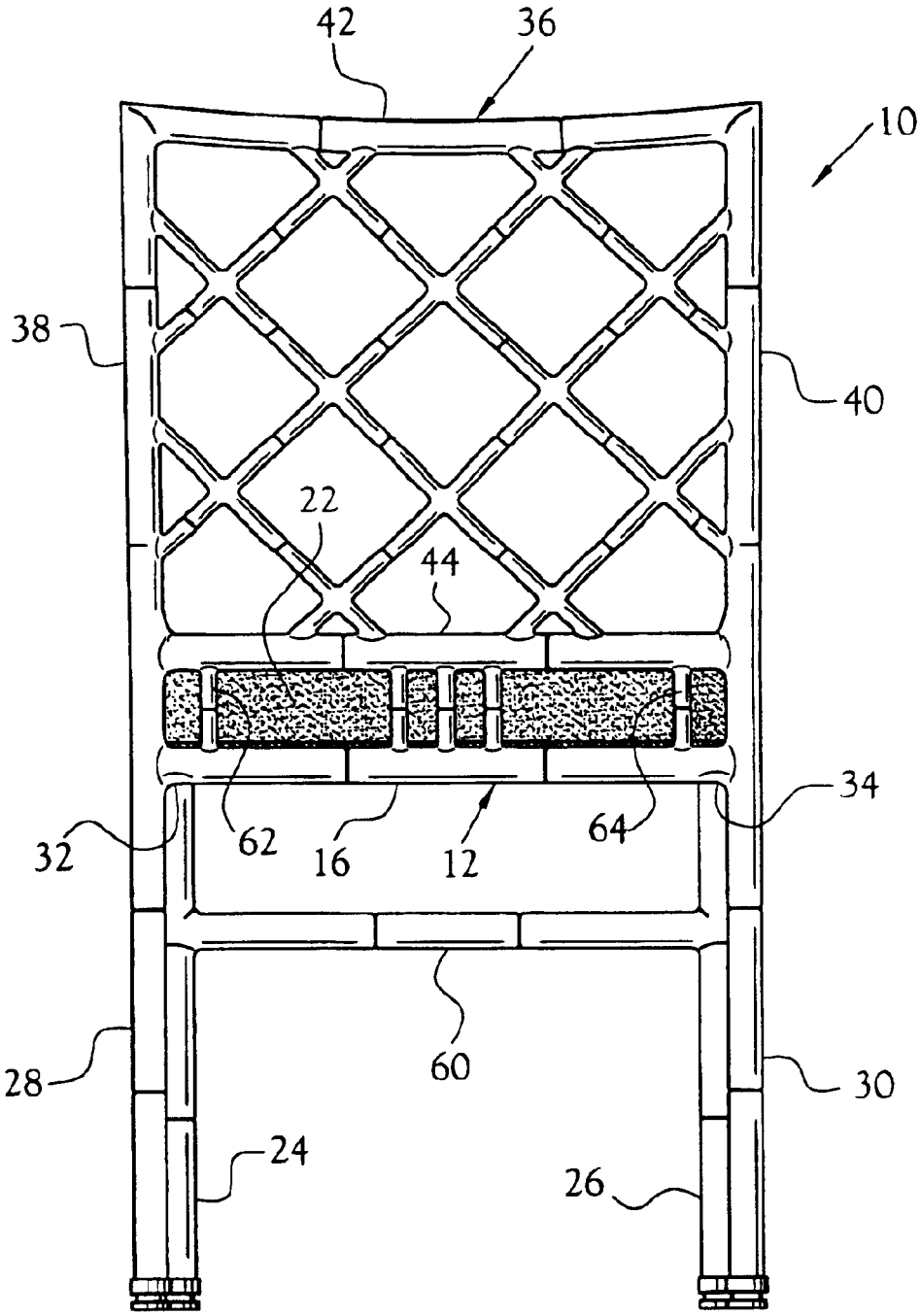
FIG. 3 is a rear elevation view of a chair frame of the present invention.

As best illustrated in FIGS. 1 and 3, the preferred embodiment of the frame 10 is further reinforced by the braces 62 and 64 which extend between the rear frame portion 16 of the seat support 12, and the lower frame portion 44 of the back support portion 36 proximate the location of the bracing structures 46 and 48, respectively. It will also be noted that in the preferred embodiment a cross brace 60 is provided which extends between the front legs 24 and 26 to strengthen the legs 24 and 26.

In light of the above, it will be recognized that the chair frame 10 provides a stackable frame which is strong and durable, and which has great advantages over the prior art. The bracing structures 46 and 48 in combination with the braces 62 and 64 significantly reinforce the connection between the seat support 12 of the frame 10 and the seat back 36. Accordingly, chairs utilizing the frame 10 are less susceptible to being bent out of shape such that they do not properly stack, and are otherwise less susceptible to damage.

At the same time, chairs utilizing the frame 10 remain easily and efficiently stackable.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

Having thus described the aforementioned invention, we claim:

1. A chair frame for a stackable chair, said chair frame comprising:

a seat support for supporting a seat of the stackable chair, said seat support defining first and second side frame portions, said seat support further defining a front frame portion and a rear frame portion, said first and second side frame portions extending between said front frame portion and said rear frame portion, said rear frame portion having a first end portion extending laterally outwardly beyond the point at which said first side frame portion engages said rear frame portion, and having a second end portion which extends laterally outwardly beyond the point at which said second side frame portion engages said rear frame portion;

first and second front leg members extending downwardly from said seat support;

first and second rear leg members extending downwardly from said seat support, said first rear leg member being secured to said first end portion of said rear frame portion whereby said first rear leg member is laterally outwardly displaced from said first side frame portion of said seat support, said second rear leg member being secured to said second end portion of said rear frame portion whereby said second rear leg member is laterally outwardly displaced from said second side frame portion of said seat support; a back support secured to said seat support, said back support defining first and second side portions and a lower frame portion disposed between said first and second side portions of said back support;

a first bracing structure secured at a first end to said first side frame portion of said seat support at a point selectively spaced from said point at which said first side frame portion engages said rear frame portion and secured at a second end to said lower frame portion of said back support at a point inwardly spaced from said first side portion of said back support, whereby said first bracing structure extends between said seat support and said back support to strengthen the engagement of said seat support with said back support without inhibiting vertical stacking of similarly configured chair frames: and a second bracing structure secured at a first end to said second side frame portion of said seat support at a point selectively spaced from said point at which said second side frame portion engages said rear frame portion and secured at a second end to said lower frame portion of said back support at a point inwardly spaced from said second side portion of said back support, whereby said second bracing structure extends between said seat support and said back support to strengthen the engagement of said seat support with said back support without inhibiting vertical stacking of similarly configured chair frames.

2. The chair frame of claim 1 wherein said chair frame further comprises a first and second brace, said first brace extending between said rear frame portion of said seat support and said lower frame portion of said back support, said first brace engaging said lower frame portion proximate the point at which said first bracing structure engages said lower frame portion, said second brace extending between said rear frame portion of said seat support and said lower frame portion of said back support, said second brace engaging said lower frame portion proximate the point at which said second bracing structure engages said lower frame portion.

3. The chair frame of claim 1 wherein said first rear leg member is integrally formed with said first side portion of said back support, and wherein said second rear leg member is integrally formed with said second side portion of said back support.

4. A chair frame for a stackable chair having a seat defining an upper surface, said chair frame comprising:

a seat support for supporting a seat of the stackable chair, said seat support defining first and second side frame portions, a front frame portion and a rear frame portion, said first and second side frame portions extending between said front frame portion and said rear frame portion, said rear frame portion having a first end portion extending laterally outwardly beyond the point at which said first side frame portion engages said rear frame portion, and having a second end portion which extends laterally outwardly beyond the point at which said second side frame portion engages said rear frame portion;

first and second front leg members extending downwardly from said seat support;

first and second rear leg members extending downwardly from said seat support, said first rear leg member being secured to said first end portion of said rear frame portion of said seat support, said second rear leg member being secured to said second end portion of said rear frame portion of said seat support, said first and second rear leg members are laterally outwardly displaced from respective first and second side frame portions whereby said rear leg members are disposed apart a greater width than said front leg members thereby providing vertical stacking of said chair frame on similarly configured chair frames;

a back support secured to said seat support, said back support defining first and second side portions and a lower frame portion disposed between said first and second side portions of said back support;

first and second bracing structures, said first bracing structure having a first end engaging said first side frame portion at a point selectively spaced from the point at which said first side frame portion engages said rear frame portion, and having a second end which engages said lower frame portion of said back support at a point inwardly spaced from said first side portion of said back support, whereby said first bracing structure extends diagonally from said first side frame portion to said lower frame portion of said back support, said second bracing structure having a first end which engages said second side frame portion at a point selectively spaced from the point at which said second side frame portion engages said rear frame portion, and having a second end which engages said lower frame portion of said back support at a point inwardly spaced from said second side portion of said back support, whereby said second bracing structure extends diagonally from said second side frame portion to said lower frame portion of said back support; and first and second braces, said first brace extending between said rear frame portion of said seat support and said lower frame portion of said back support, said first brace having an upper end engaging said lower frame portion proximate the point at which said first bracing structure engages said lower frame portion and having a lower end engaging said rear frame Portion proximate the point at which said first side frame portion engages said rear frame portion, said second brace extending between said rear frame portion of said seat support and said lower frame portion of said back support, said second brace having an upper end engaging said lower frame portion proximate the point at which said second bracing structure engages said lower frame portion and having a lower end engaging said rear frame portion proximate the point at which said second side frame portion engages said rear frame portion.

5. The chair frame of claim 4 wherein said second end portions of said first and second bracing structures engage said lower frame portion of said back support proximate the level of the upper surface of the seat of a chair utilizing said chair frame, whereby said first and second bracing structures do not interfere with the stacking of chairs utilizing said chair frame.

6. The chair frame of claim 4 wherein said first rear leg member is integrally formed with said first side portion of said back support, and wherein said second rear leg member is integrally formed with said second side portion of said back support.

7. A chair frame for a stackable chair, said chair frame comprising:

a seat support defining first and second side frame portions, said seat support further defining a front frame portion and a rear frame portion, said first and second side frame portions extending between said front frame portion and said rear frame portion, said rear frame portion having a first end portion extending laterally outwardly beyond the point at which said first side frame portion engages said rear frame portion, and having a second end portion which extends laterally outwardly beyond the point at which said second side frame portion engages said rear frame portion;

first and second front leg members extending downwardly from said seat support;

first and second rear leg members extending downwardly from said seat support, said first rear leg member being secured to said first end portion of said rear frame portion whereby said first rear leg member is laterally outwardly displaced from said first side frame portion of said seat support, said second rear leg member being secured to said second end portion of said rear frame portion whereby said second rear leg member is laterally outwardly displaced from said second side frame portion of said seat support;

a back support secured to said seat support, said back support defining first and second side portions and a lower frame portion disposed between said first and second side portions of said back support;

a first bracing structure secured at a first end to said first side frame portion of said seat support at a point selectively spaced from said point at which said first side frame portion engages said rear frame portion and secured at a second end to said lower frame portion of said back support at a point inwardly spaced from said first side portion of said back support, whereby said first bracing structure extends between said seat support and said back support to strengthen the engagement of said seat support with said back support without inhibiting vertical stacking of similarly configured chair frames;

a second bracing structure secured at a first end to said second side frame portion of said seat support at a point selectively spaced from said point at which said second side frame portion engages said rear frame portion and secured at a second end to said lower frame portion of said back support at a point inwardly spaced from said second side portion of said back support, whereby said second bracing structure extends between said seat support and said back support to strengthen the engagement of said seat support with said back support without inhibiting vertical stacking of similarly configured chair frames; and a seat supported by said seat support of the chair frame, said seat defining an upper surface, and wherein said second end portions of said first and second bracing structures engage said lower frame portion of said back support proximate the level of the upper surface of the seat of a chair utilizing said chair frame, whereby said first and second bracing structures do not interfere with the stacking of chairs utilizing said chair frame.

8. The chair frame of claim 7 wherein said chair frame further comprises a first and second brace, said first brace extending between said rear frame portion of said seat support and said lower frame portion of said back support, said first brace engaging said lower frame portion proximate the point at which said first bracing structure engages said lower frame portion, said second brace extending between said rear frame portion of said seat support and said lower frame portion of said back support, said second brace engaging said lower frame portion proximate the point at which said second bracing structure engages said lower frame portion.

9. The chair frame of claim 7 wherein said first rear leg member is integrally formed with said first side portion of said back support, and wherein said second rear leg member is integrally formed with said second side portion of said back support.

* * * * *